US012487024B2

(12) United States Patent
Zhao et al.

(10) Patent No.: US 12,487,024 B2
(45) Date of Patent: Dec. 2, 2025

(54) REFRIGERATOR

(71) Applicants: HEFEI HAIER REFRIGERATOR CO., LTD, Anhui (CN); QINGDAO HAIER REFRIGERATOR CO., LTD., Shandong (CN); HAIER SMART HOME CO., LTD., Shandong (CN)

(72) Inventors: Yanfeng Zhao, Shandong (CN); Peng Lyu, Shandong (CN); Hao Zhang, Shandong (CN); Zhanzhan Liu, Shandong (CN); Xiangpeng Song, Shandong (CN)

(73) Assignees: HEFEI HAIER REFRIGERATOR CO., LTD, Anhui (CN); QINGDAO HAIER REFRIGERATOR CO., LTD., Shandong (CN); HAIER SMART HOME CO. LTD., Shandong (CN)

( * ) Notice: Subject to any disclaimer, the term of this patent is extended or adjusted under 35 U.S.C. 154(b) by 134 days.

(21) Appl. No.: 18/553,373

(22) PCT Filed: Jan. 13, 2022

(86) PCT No.: PCT/CN2022/071768
§ 371 (c)(1),
(2) Date: Sep. 29, 2023

(87) PCT Pub. No.: WO2022/206118
PCT Pub. Date: Oct. 6, 2022

(65) Prior Publication Data

US 2024/0183607 A1 Jun. 6, 2024

(30) Foreign Application Priority Data

Apr. 2, 2021 (CN) ..... 202110362830.9

(51) Int. Cl.
*F25D 23/02* (2006.01)

(52) U.S. Cl.
CPC ..... *F25D 23/028* (2013.01); *F25D 2323/021* (2013.01)

(58) Field of Classification Search
CPC ..... F25D 23/028; F25D 2323/021
See application file for complete search history.

(56) References Cited

U.S. PATENT DOCUMENTS 7,008,032 B2 * 3/2006 Chekal ..... F25D 23/02 49/316
9,506,689 B2 * 11/2016 Carbajal ..... F25D 23/02
2024/0191935 A1 * 6/2024 Zhao ..... F25D 23/028

FOREIGN PATENT DOCUMENTS

CN 104344652 A * 2/2015 ..... F25D 23/028
CN 105674672 A 6/2016
(Continued)

OTHER PUBLICATIONS

Translation CN106052275A (Year: 2016).*
Translation CN206600959U (Year: 2017).*
Translation CN207515342U (Year: 2018).*

*Primary Examiner* — Andrew Roersma
(74) *Attorney, Agent, or Firm* — MUNCY, GEISSLER, OLDS & LOWE, P.C.

(57) ABSTRACT

A refrigerator includes a cabinet having an inner liner, the inner liner having a storage compartment having a front opening; a side-by-side door assembly including a first door and a second door; a vertical beam assembly, which is in whole rotatably mounted at a side of the first door away from a pivoting center of the first door, and which abuts against the second door when the first door and the second door are closed, so as to seal a gap between the first door, the second door, and the cabinet. The vertical beam assembly includes a vertical beam body; and a telescopic member, which is
(Continued)

extendably arranged at a bottom end of the vertical beam body, and which abuts against a bottom wall of an inner liner of the storage compartment.

7 Claims, 8 Drawing Sheets

(56) References Cited

FOREIGN PATENT DOCUMENTS

| | | | | |
|---|---|---|---|---|
| CN | 106052275 | A | | 10/2016 |
| CN | 106595203 | A | * | 4/2017 |
| CN | 206600959 | U | | 10/2017 |
| CN | 207515342 | U | | 6/2018 |
| CN | 215260706 | U | | 12/2021 |
| CN | 215638274 | U | | 1/2022 |
| KR | 101315492 | B1 | * | 10/2013 |
| KR | 20200021823 | A | | 3/2020 |
| WO | WO-2011154425 | A2 | * | 12/2011 |
| WO | WO-2020/126471 | A1 | | 6/2020 |
| WO | WO-2022181973 | A1 | * | 9/2022 |

* cited by examiner

REFRIGERATOR

TECHNICAL FIELD

The present invention relates to the field of household appliances, and in particular, to a refrigerator.

BACKGROUND

A large volume refrigerator in a prior art usually has a left-right side-by-side structure, and since a certain gap exists between a left door and a right door, a vertical beam for sealing is required to be mounted on one door, so as to prevent cold air in a storage compartment from leaking from the gap between the two doors. However, certain gaps still exist between two ends of the vertical beam and a cabinet of the refrigerator, such that the cold air in the storage compartment can still leak through the gaps at the two ends of the vertical beam, thereby influencing a refrigerating effect of the refrigerator, and reducing use experiences of customers.

Furthermore, in an opening-closing process of a door, generally, a bottom end of the whole vertical beam of the refrigerator in the prior art directly rubs with an inner liner of the refrigerator for overturning, which influences overturning smoothness of the vertical beam on the one hand, and is prone to seriously wear the cabinet on the other hand.

SUMMARY

An object of the present invention is to provide a refrigerator which solves at least one of the above-mentioned technical problems.

A further object of the present invention is to improve a sealing performance between a vertical beam and a cabinet of the refrigerator.

Another object of the present invention is to improve overturning smoothness of the vertical beam of the refrigerator.

In particular, the present invention is directed to a refrigerator, comprising:

- a cabinet having an inner liner, the inner liner defining a storage compartment having a front opening;
- a side-by-side door assembly comprising a first door and a second door pivotably provided on both sides of the front opening of the storage compartment respectively, so as to open or close the storage compartment; and
- a vertical beam assembly overall rotatably mounted on a side of the first door apart from a pivoting center of the first door, and abutting against the second door when the first door and the second door are closed, so as to close a gap between the first door, the second door and the cabinet; and the vertical beam assembly comprising:
- a vertical beam body; and
- a telescopic member telescopically provided at a bottom end of the vertical beam body and abutting against a bottom wall of the inner liner of the storage compartment.

Further, the telescopic member comprises:

- an end cover clamped at the bottom end of the vertical beam body; and
- a spring provided above the end cover, and having one end abutting against the bottom end of the vertical beam body and the other end abutting against the end cover.

Further, at least one buckle is provided at a lower portion of a side wall of the vertical beam body, at least one clamping portion is correspondingly provided on the end cover, and each clamping portion is fitted with each buckle to limit a maximum extension length of the end cover from the vertical beam body.

Further, the lower portion of the side wall of the vertical beam body is further provided with a guide protrusion, the end cover is correspondingly provided with a guide groove, and the guide protrusion is fitted with the guide groove to guide the end cover to extend and retract.

Further, an abutting surface is provided at a bottom end of the end cover, and an outer circumference outline of the end cover is gradually enlarged upwards from the abutting surface in a longitudinal direction.

Further, a protruding rib is provided at a position of a front end of the bottom wall of the inner liner opposite to the end cover, so as to jack the end cover to correspondingly retract the end cover.

Further, the protruding rib comprises:

- a first transverse section located in a middle of the bottom wall of the inner liner and spaced apart from a front edge of the bottom wall of the inner liner by a set length;
- a first inclined section and a second inclined section extending obliquely from both ends of the first transverse section to the front edge of the bottom wall of the inner liner respectively; and
- a second transverse section and a third transverse section oppositely extending from tail ends of the first inclined section and the second inclined section in a transverse direction respectively.

Further, the bottom end of the vertical beam body is further provided with a positioning block, and the spring is fitted over the positioning block to position the spring; and an outer circumference outline of the positioning block is generally rectangular, and a cross section outline of the spring has a rectangular shape matched with the outer circumference outline of the positioning block.

Further, a first sealing part and a second sealing part are provided at positions of the bottom wall and a top wall of the inner liner opposite to the vertical beam assembly respectively, and when the first door is closed, the vertical beam assembly abuts against the first sealing part and the second sealing part.

Further, the first sealing part and the second sealing part are configured as sealing strips, and an extending direction thereof is set according to a rotation track of the vertical beam assembly on the inner liner.

In the refrigerator according to the present invention, a telescopic member is provided at a bottom end of a vertical beam body and abuts against a bottom wall of an inner liner of a storage compartment, thereby eliminating a gap between the bottom end of the vertical beam and the storage compartment, improving the sealing performance between the vertical beam and the cabinet, and then improving a refrigerating effect of the refrigerator.

Further, in the refrigerator according to the present invention, buckles are arranged on a lower portion of a side wall of the vertical beam body, corresponding clamping portions are arranged on an end cover of the telescopic member, and the clamping portions are in one-to-one correspondence with the buckles, thereby limiting a maximum extension length of the end cover from the vertical beam body, so as to prevent the end cover from being completely separated from the vertical beam body and guarantee normal extension and retraction of the end cover.

Further, in the refrigerator according to the present invention, a guide protrusion is provided on the vertical beam body, a corresponding guide groove is provided in the end cover, and the guide protrusion and the guide groove are fitted to guide the end cover to extend and retract, thereby guaranteeing smooth extension and retraction of the end cover.

Further, in the refrigerator according to the present invention, an outer circumference outline of the end cover is gradually enlarged upwards from an abutting surface, such that the end cover can extend and retract more smoothly when coming into contact with the bottom wall of the inner liner.

Further, in the refrigerator according to the present invention, a protruding rib for jacking the end cover to retract is provided on the bottom wall of the inner liner, such that a friction area between the end cover and the inner liner is reduced, and overturning smoothness of a vertical beam assembly is improved while abrasion of the inner liner is reduced.

Further, in the refrigerator according to the present invention, a cross section of a spring for providing the end cover with a telescopic elastic force has a rectangular outline, such that the elastic force applied to the end cover by the spring is distributed more uniformly, thereby improving telescopic stability of the end cover.

Further, in the refrigerator according to the present invention, a first sealing part and a second sealing part are arranged on an inner side of a top wall and an inner side of the bottom wall of the inner liner respectively, such that when a first door is closed, two ends of the vertical beam assembly abut against the first sealing part and the second sealing part respectively, thereby improving the sealing performance between the vertical beam assembly and the inner liner of the cabinet.

The above and other objects, advantages and features of the present invention will become more apparent to those skilled in the art from the following detailed description of specific embodiments thereof taken in conjunction with the accompanying drawings.

BRIEF DESCRIPTION OF THE DRAWINGS

Some specific embodiments of the invention will be described in detail hereinafter by way of example and not by way of limitation with reference to the accompanying drawings. The same reference numerals identify the same or similar components or parts in the drawings. Those skilled in the art should appreciate that the drawings are not necessarily drawn to scale. In the drawings.

DETAILED DESCRIPTION

Figure 1:
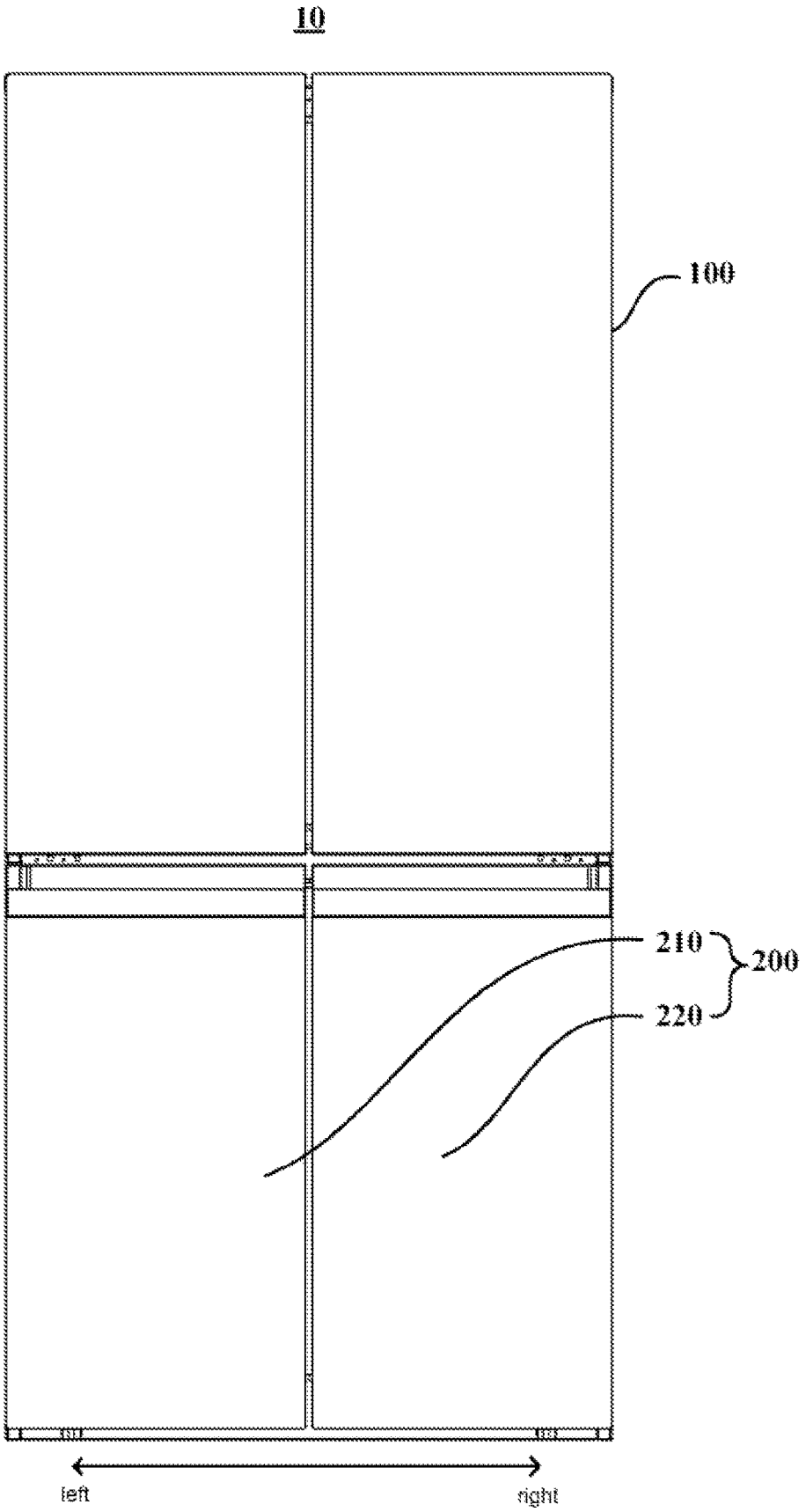
FIG. 1 is a schematic structural diagram of a refrigerator according to an embodiment of the present invention.

Hereinafter, the present invention will be described in detail in conjunction with specific embodiments shown in FIGS. 1 to 14. However, these embodiments have no limitations on the present invention, and any transformations of structure, method, or function made by persons skilled in the art according to these embodiments fall within the protection scope of the present invention.

In the description of the present embodiment, it should be understood that the terms "transverse", "longitudinal", "thickness", "upper", "lower", "front", "top", "bottom", or the like, indicate orientations or positional relationships based on orientations in a normal use state of a refrigerator 10 and can be determined with reference to orientations or positional relationships shown in the drawings, for example, "front" indicating an orientation refers to a side of the refrigerator 10 facing a user during normal use. The terms are used only for describing the present invention and for description simplicity, but do not indicate or imply that an indicated device or element must have a specific orientation or be constructed and operated in a specific orientation. Therefore, it cannot be understood as a limitation on the present invention.

Figure 2:
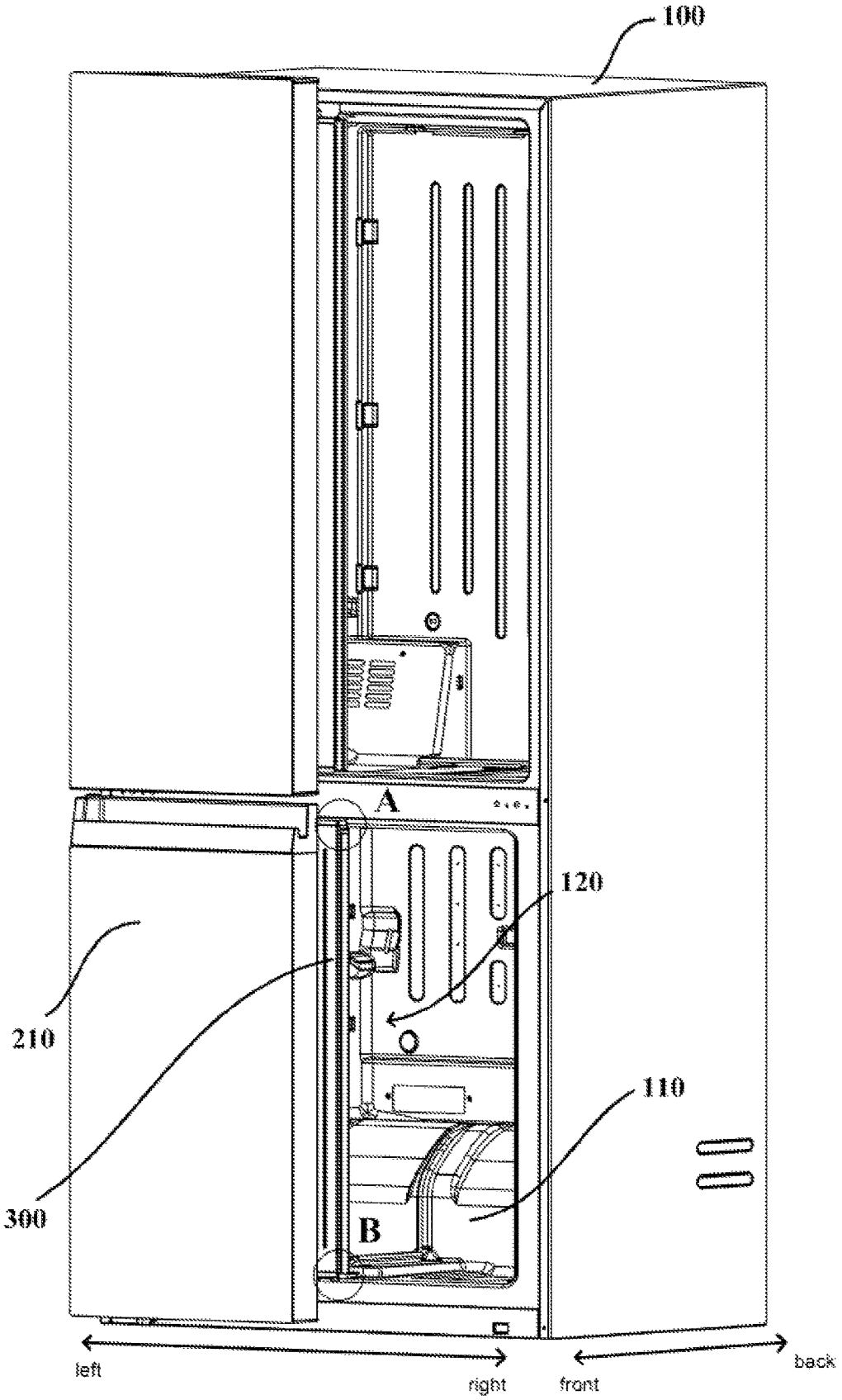
FIG. 2 is a schematic structural diagram of the refrigerator according to the embodiment of the present invention with a first door in a closed state.
Figure 3:
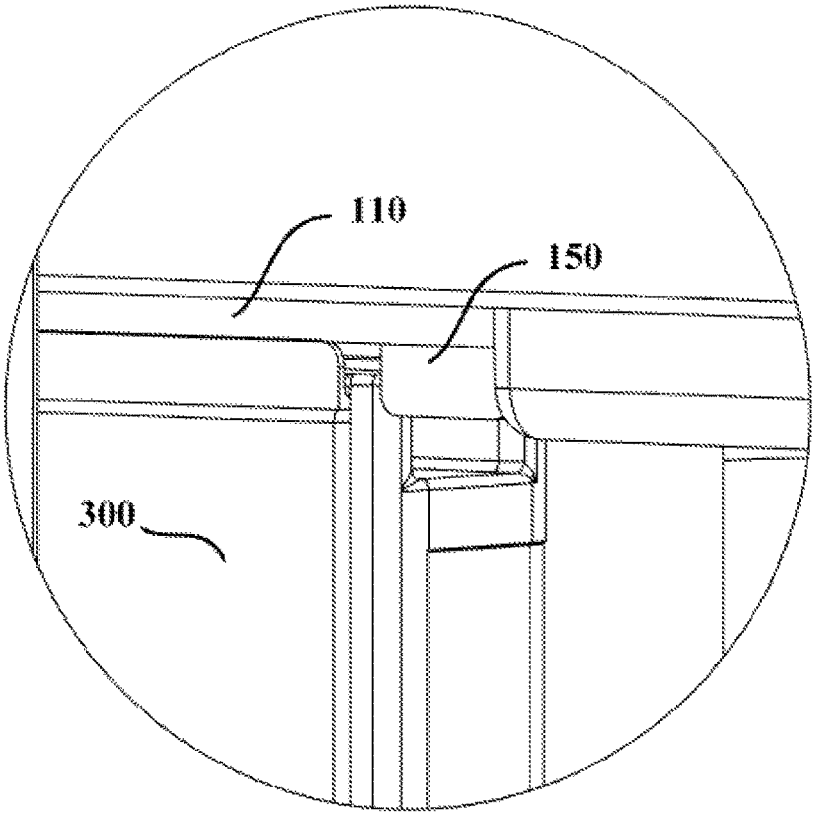
FIG. 3 is a partial enlarged view of region A of FIG. 2.
Figure 4:
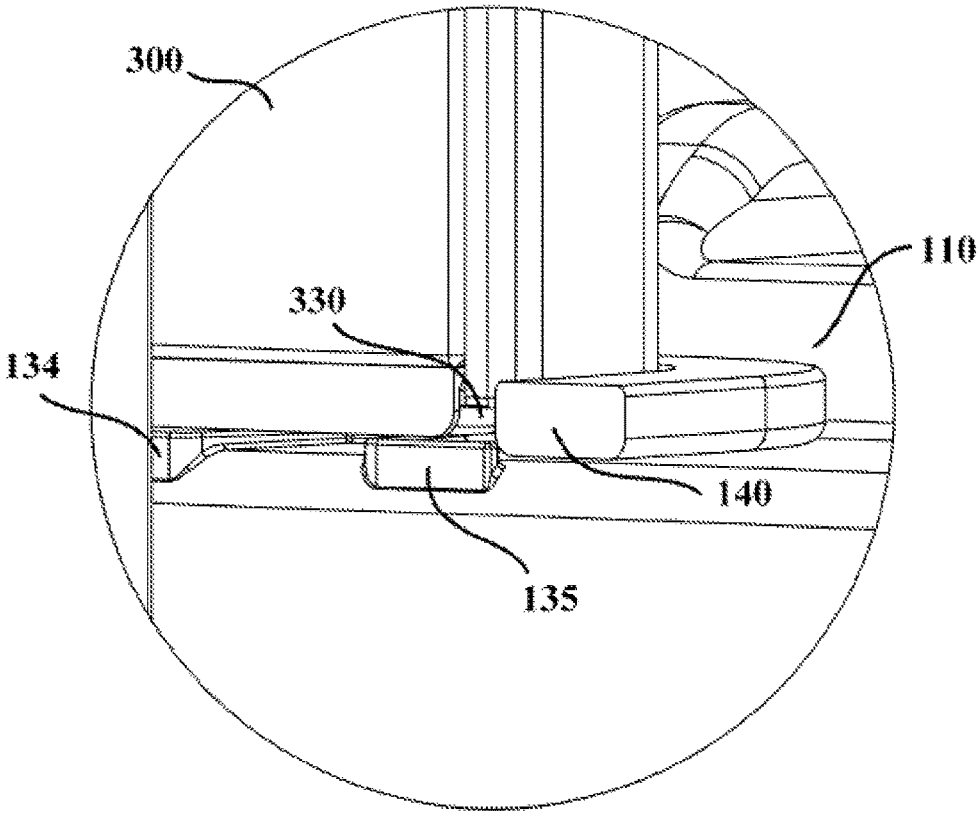
FIG. 4 is a partial enlarged view of region B of FIG. 2.

FIG. 1 is a schematic structural diagram of a refrigerator 10 according to an embodiment of the present invention. FIG. 2 is a schematic structural diagram of the refrigerator 10 according to the embodiment of the present invention with a first door 210 in a closed state. FIG. 3 is a partial enlarged view of region A of FIG. 2. FIG. 4 is a partial enlarged view of region B of FIG. 2.

In FIG. 2, a second door 220 located on a right side of the refrigerator 10 is hidden to better show a corresponding structure of the vertical beam 300 of the refrigerator 10.

Referring to FIGS. 1 to 4, the present embodiment first provides a refrigerator 10, and the refrigerator 10 may generally include a cabinet 100, a side-by-side door assembly 200 and a vertical beam assembly 300.

The cabinet 100 generally has an inner liner 110, and the inner liner 110 defines a storage compartment 120 having a front opening.

The side-by-side door assembly 200 includes a first door 210 and a second door 220 which are pivotably provided on both sides of the front opening of the storage compartment 120 respectively, so as to open or close the storage compartment 120.

In some embodiments, the first door 210 and the second door 220 have a same size, and when the side-by-side door assembly 200 is closed, a gap formed between the first door 210 and the second door 220 is located in a middle of the cabinet 100. In other embodiments, the first door 210 and the second door 220 have different transverse sizes, and the gap formed therebetween is deviated from the middle of the cabinet 100.

The vertical beam assembly 300 is overall rotatably mounted on a side of the first door 210 apart from a pivoting center of the first door 210, and abuts against the second door 220 when the first door 210 and the second door 220 are closed, so as to close a gap between the first door 210, the second door 220 and the cabinet 100.

In other embodiments, the vertical beam assembly 300 may also be provided on the second door 220. It may be understood that a specific mounting position of the vertical beam assembly 300 can be set according to actual requirements.

The vertical beam assembly 300 may further include a vertical beam body 310 and a telescopic member 320.

The telescopic member 320 is telescopically provided at a bottom end of the vertical beam body 310 and abuts against a bottom wall of the inner liner 110 of the storage compartment 120.

In the solution of the present embodiment, the telescopic member 320 is provided at the bottom end of the vertical beam body 310, such that in the closing process of the side-by-side door assembly 200 of the refrigerator 10, the telescopic member 320 always abuts against an inner side of the bottom wall of the inner liner 110, thereby eliminating a gap between the bottom end of the vertical beam assembly 300 and the bottom wall of the inner liner 110, improving a sealing performance between the vertical beam assembly 300 and the cabinet 100, and improving a refrigerating effect of the refrigerator 10.

In other embodiments, the refrigerator 10 may have a plurality of inner cavities 110, and different storage compartments 120 may be defined according to different functions, such as a freezing compartment for freezing and a refrigerating compartment for refrigeration by a user. The opening of each storage compartment 120 can be provided with the side-by-side door assembly 200, and each side-by-side door assembly 200 can be provided with the vertical beam assembly 300 including the vertical beam body 310 and the telescopic member 320.

Figure 5:
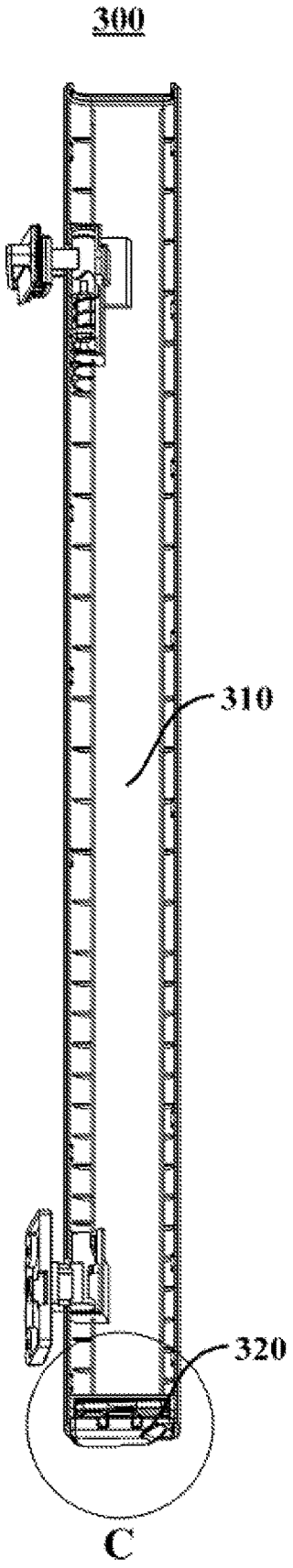
FIG. 5 is a schematic structural diagram of a vertical beam assembly of the refrigerator according to the embodiment of the present invention.
Figure 6:
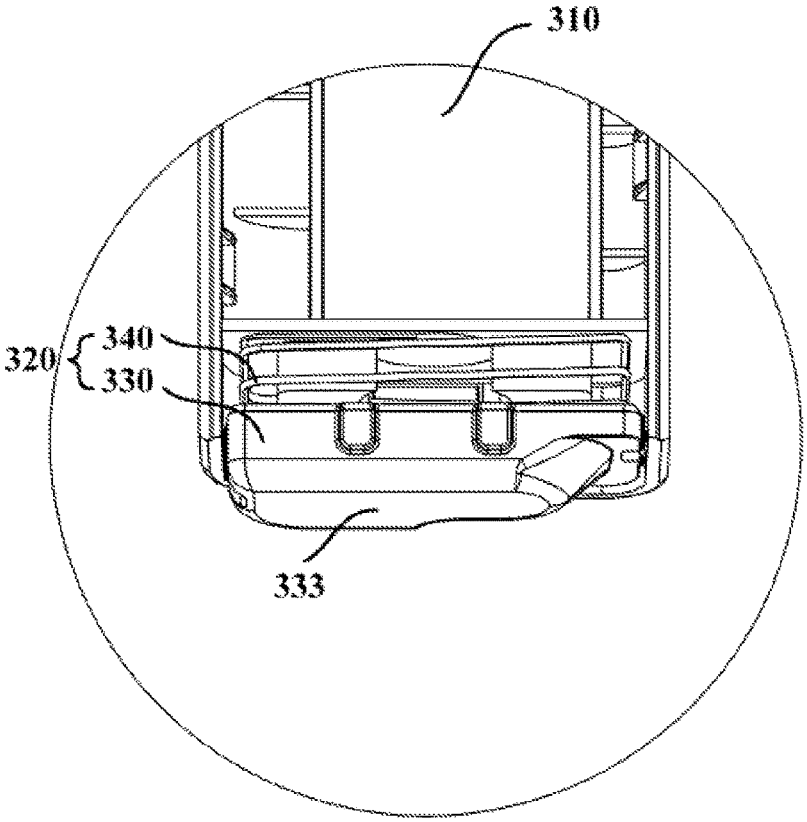
FIG. 6 is a partial enlarged view of region C of FIG. 5.
Figure 7:
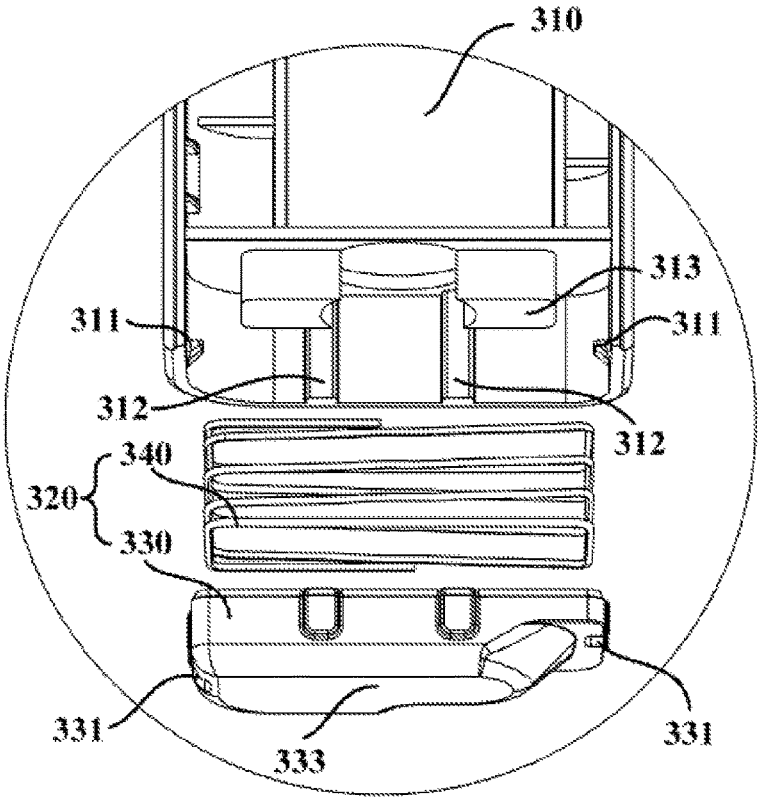
FIG. 7 is an exploded view of the vertical beam assembly shown in FIG. 6.

FIG. 5 is a schematic structural diagram of the vertical beam assembly 300 of the refrigerator 10 according to the embodiment of the present invention. FIG. 6 is a partial enlarged view of region C of FIG. 5. FIG. 7 is an exploded view of the vertical beam assembly 300 shown in FIG. 6.

In FIGS. 5 and 7, in order to better show a fitting relationship between the telescopic member 320 and the vertical beam body 310 in the vertical beam assembly 300, a structure of the vertical beam body 310 in front of the telescopic member 320 is hidden.

Referring to FIGS. 5 to 7, in the solution of the present embodiment, the telescopic member 320 may generally include an end cover 330 and a spring 340.

The end cover 330 is clamped at the bottom end of the vertical beam body 310; the spring 340 is provided above the end cover 330, and has one end abutting against the bottom end of the vertical beam body 310 and the other end abutting against the end cover 330.

In the solution of the present embodiment, the end cover 330 is provided at the bottom end of the vertical beam body 310, such that an opening at the bottom end of the vertical beam body 310 is closed, thus improving a heat insulation performance of the vertical beam body 310. Furthermore, the spring 340 is provided above the end cover 330, such that the end cover 330 can maximally abut against the bottom wall of the inner liner 110 under an action of an elastic force of the spring 340, thereby eliminating the gap between the vertical beam assembly 300 and the bottom wall of the inner liner 110.

Further, in order to ensure that the end cover 330 can better abut against the bottom wall of the inner liner 110 under the action of the elastic force of the spring 340, the spring 340 is always in a compressed state during a whole extension and retraction process.

When the first door 210 is in an open state, the spring 340 is located at a minimum compression position, and the end cover 330 extends from the vertical beam body 310 by a maximum extension length under the action of the elastic force of the spring 340.

When the first door 210 is in a closed state, the spring 340 is in a maximum compression state, and the end cover 330 is jacked by the bottom wall of the inner liner 110 to extend from the vertical beam body 310 by a minimum extension length.

Figure 8:
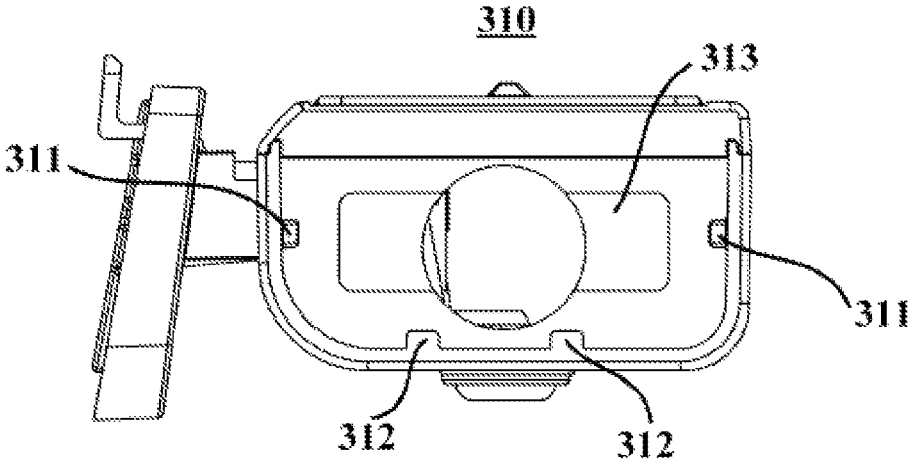
FIG. 8 is a schematic structural diagram of a vertical beam body of the refrigerator according to the embodiment of the present invention.
Figure 9:
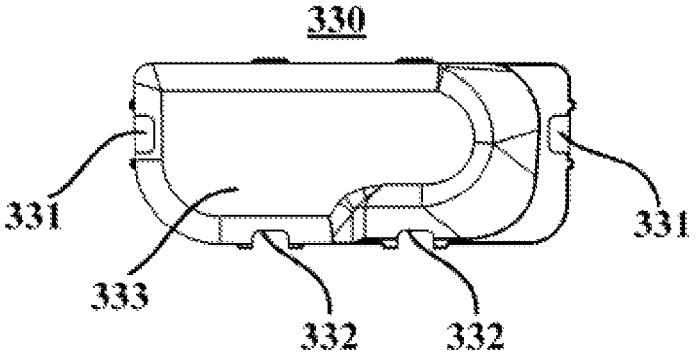
FIG. 9 is a schematic structural diagram of an end cover of the refrigerator according to the embodiment of the present invention.
Figure 10:
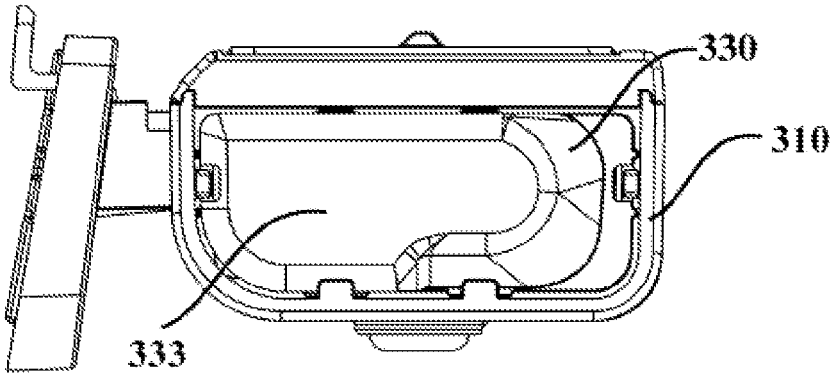
FIG. 10 is a schematic mounting structure diagram of the vertical beam body and the end cover of the refrigerator according to the embodiment of the present invention.

FIG. 8 is a schematic structural diagram of the vertical beam body 310 of the refrigerator 10 according to the embodiment of the present invention. FIG. 9 is a schematic structural diagram of the end cover 330 of the refrigerator 10 according to the embodiment of the present invention. FIG. 10 is a schematic mounting structure diagram of the vertical beam body 310 and the end cover 330 of the refrigerator 10 according to the embodiment of the present invention. FIGS. 8 to 10 are schematic structural diagrams from bottom.

At least one buckle 311 is provided at a lower portion of a side wall of the vertical beam body 310, at least one clamping portion 331 is correspondingly provided on the end cover 330, and each clamping portion 331 is fitted with each buckle 311 to limit the maximum extension length of the end cover 330 from the vertical beam body 310.

Referring to FIGS. 8 to 10, in the solution of the present embodiment, two opposite buckles 311 are arranged on the lower portion of the side wall of the vertical beam body 310, two clamping portions 331 are correspondingly arranged on the end cover 330, and the buckles 311 are in one-to-one correspondence with the clamping portions 331. In the telescopic process of the end cover 330, when the end cover 330 extends by a certain length, the clamping portion 331 abuts against the buckle 311, such that the end cover 330 cannot extend downwards any more, thereby defining the maximum extension length of the end cover 330 from the vertical beam body 310.

In the solution of the present embodiment, limiting structures are provided on the vertical beam body 310 and the end cover 330, thus avoiding that the end cover 330 is separated from the vertical beam body 310, such that the end cover 330 cannot normally extend and retract.

Furthermore, the most suitable maximum extension length of the end cover 330 can be defined by providing the limiting structure, thus avoiding that an excessively large extension length of the end cover 330 causes an overlarge retraction length when the end cover 330 abuts against the bottom wall of the inner liner 110, thereby influencing extension and retraction smoothness of the end cover 330.

The lower portion of the side wall of the vertical beam body 310 is further provided with a guide protrusion 312, the end cover 330 is correspondingly provided with a guide groove 332, and the guide protrusion 312 is fitted with the guide groove 332 to guide the end cover 330 to extend and retract.

Referring to FIGS. 5 to 10, in the solution of the present embodiment, two elongated guide protrusions 312 are further provided on the lower portion of the side wall of the vertical beam body 310, guide grooves 332 fitted with the two guide protrusions 312 are correspondingly provided on the end cover 330, and the end cover 330 is guided by the cooperation of the guide protrusions 312 and the guide grooves 332 to move up and down along a longitudinal direction of the vertical beam body 310, so as to improve the extension and retraction smoothness of the end cover 330.

It may be understood that, in some embodiments, numbers of the guide protrusions 312 and the guide grooves 332 may be one or more, the specific number may be set according to actual requirements, and positions of the guide protrusions 312 and the guide grooves 332 may also be adjusted according to the structures of the vertical beam body 310 and the end cover 330 and the actual requirements.

For example, in some embodiments, the vertical beam body 310 may be provided with one guide groove 332 and the end cover 330 may be correspondingly provided with one guide protrusion 312. In other embodiments, three guide protrusions 312 may be provided on the vertical beam body 310, and three guide grooves 332 may be correspondingly provided on the end cover 330.

An abutting surface 333 is provided at a bottom end of the end cover 330, and an outer circumference outline of the end cover 330 is gradually enlarged upwards from the abutting surface 333 in the longitudinal direction.

In the solution of the present embodiment, by providing the bottom end of the end cover 330 to extend gradually upwards from the abutting surface 333 along the longitudinal direction (that is, a bottom of the end cover 330 tapers gradually downwards along the longitudinal direction), a resistance between the end cover 330 and the bottom wall of the inner liner 110 is reduced, such that the end cover 330 can more smoothly extend and retract in the process of coming into contact with the bottom wall of the inner liner 110.

In the solution of the present embodiment, a height of the bottom end of the end cover 330 gradually tapering downwards is adapted to the maximum extension length of the end cover 330, so as to avoid that due to the overlarge extension length of the end cover 330 from the vertical beam body 310, an inclined surface of the end cover 330 cannot abut against a front end of the bottom wall of the inner liner 110, thereby affecting extension and retraction of the end cover 330.

It can be understood that the vertical beam assembly 300 in the present embodiment can be overturned on the side of the first door 210 apart from the pivoting center of the first door 210, and in an opening and closing process of the first door 210, the vertical beam assembly 300 is overturned under a guiding action of a guide part (not shown) at a top end of the vertical beam assembly 300.

After the first door 210 is opened, the vertical beam assembly 300 is overturned relative to the first door 210 to some extent, and at this point, a right side of the vertical beam assembly 300 faces an interior of the inner liner 110 of the refrigerator 10; that is, the right side of the end cover 330 is closer to a front end of the inner liner 110 of the refrigerator 10.

Referring to FIGS. 5 to 7, in the solution of the present embodiment, the right side of the bottom end of the end cover 330 may also be configured as an arc-shaped inclined surface extending obliquely upwards from the abutting surface 333.

When the first door 210 is ready to be closed, the arc-shaped inclined surface on the right side of the end cover 330 first comes into contact with the bottom wall of the inner liner 110, and then starts to move towards the interior of the inner liner 110 and retract upwards under driving of the first door 210 and jacking of the bottom wall of the inner liner 110. The arc-shaped inclined surface further reduces the resistance between the end cover 330 and the bottom wall of the inner liner 110, which is more favorable for stable and smooth retraction of the end cover 330.

An inclination angle of the arc-shaped inclined surface can be set according to actual requirements, and the smaller the angle of the inclined surface relative to a horizontal plane, the smoother the extension and retraction of the end cover 330.

Figure 11:
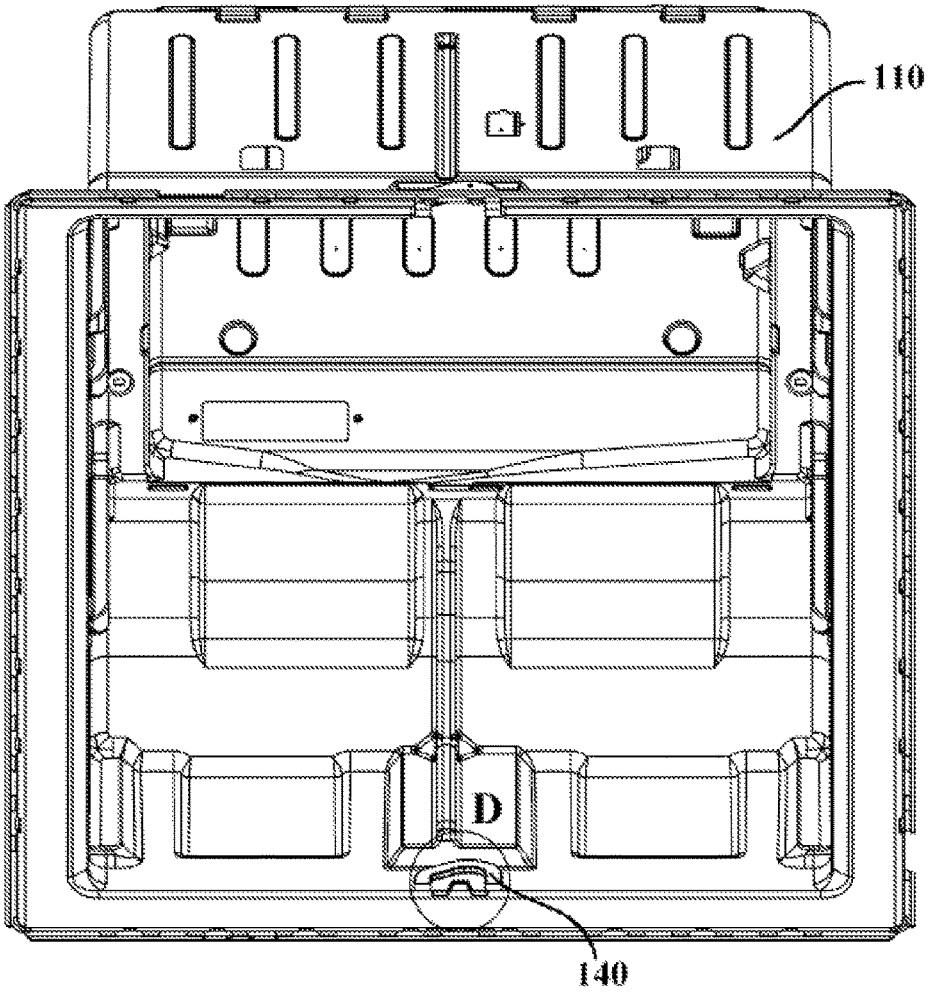
FIG. 11 is a schematic structural diagram of an inner liner of the refrigerator according to the embodiment of the present invention.
Figure 12:
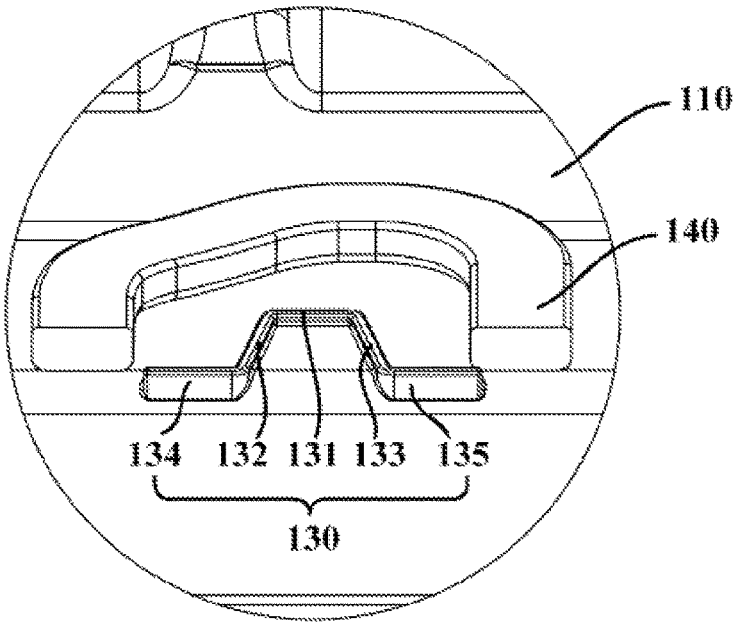
FIG. 12 is a partial enlarged view of region D of FIG. 11.

FIG. 11 is a schematic structural diagram of the inner liner 110 of the refrigerator 10 according to the embodiment of the present invention. FIG. 12 is a partial enlarged view of region D of FIG. 11.

A protruding rib 130 is provided at a position of the front end of the bottom wall of the inner liner 110 opposite to the end cover 330, so as to jack the end cover 330 to correspondingly retract the end cover 330.

In the solution of the present embodiment, the protruding rib 130 for jacking the end cover 330 is provided at the front end of the bottom wall of the inner liner 110, such that direct friction between the abutting surface 333 of the end cover 330 and the bottom wall of the inner liner 110 is avoided, thus reducing abrasion of the inner liner 110.

The protruding rib 130 may further include: a first transverse section 131 located in a middle of the bottom wall of the inner liner 110 and spaced apart from a front edge of the bottom wall of the inner liner 110 by a set length; a first inclined section 132 and a second inclined section 133 extending obliquely from both ends of the first transverse section 131 to the front edge of the bottom wall of the inner liner 110; and a second transverse section 134 and a third transverse section 135 oppositely extending from tail ends of the first inclined section 132 and the second inclined section 133 in a transverse direction respectively.

In the solution of the present embodiment, the protruding rib 130 is provided according to an overturning track of the vertical beam assembly 300, and generally includes three parts.

The first transverse section 131 located in the middle of the bottom wall of the inner liner 110 serves as a first part, and the first transverse section 131 is a set length from the front edge of the bottom wall of the inner liner 110. The set length is set according to a size of the end cover 330 of the vertical beam assembly 300, so as to ensure that after the first door 210 is closed, the end cover 330 can just abut against the first transverse section 131, thereby eliminating the gap.

The first inclined section 132 and the second inclined section 133 extending obliquely from both ends of the first transverse section 131 to the front edge of the bottom wall of the inner liner 110 respectively serve as a second part. The first inclined section 132 is inclined to the left front of the inner liner 110, and the second inclined section 133 is inclined to the right front of the inner liner 110.

The second transverse section 134 and the third transverse section 135 oppositely extending from the tail ends of the first inclined section 132 and the second inclined section 133 respectively serve as a third part. The second transverse section 134 extends leftwards from the tail end of the first inclined section 132, and the third transverse section 135 extends rightwards from the tail end of the second inclined section 133.

In the closing process of the first door 210, the arc-shaped inclined surface at a right portion of the end cover 330 of the vertical beam assembly 300 abuts against the first transverse section 131, and then moves backwards and upwards relative to the cabinet 100 until the abutting surface 333 of the end cover 330 abuts against the first transverse section 131. Then, the end cover 330 is driven by the rotating vertical beam body 310 to start to slide relative to the first transverse section 131, and comes into contact with the first inclined section 132, the first transverse section 131 and the second inclined section 133 in sequence along a structural shape of the protruding rib 130. When the first door 210 is completely closed, the end cover 330 abuts against the first transverse section 131, the first inclined section 132 and the second inclined section 133 to close the gap between the vertical beam assembly 300 and the bottom wall of the inner liner 110.

In other embodiments, the vertical beam assembly 300 can be further mounted on the second door 220, and when the second door 220 is closed, the end cover 330 of the vertical beam assembly 300 slides along a track from the second transverse section 134 to the second inclined section 133 and then to the first transverse section 131 and the first inclined section 132.

The bottom end of the vertical beam body 310 is further provided with a positioning block 313, and the spring 340 is fitted over the positioning block 313 to position the spring 340; an outer circumference outline of the positioning block 313 is generally rectangular, and a cross section outline of the spring 340 has a rectangular shape matched with the outer circumference outline of the positioning block 313.

In the solution of the present embodiment, the spring 340 is positioned by providing the positioning block 313 at the bottom end of the vertical beam body 310, thereby avoiding that the spring 340 is deviated and shaken in the telescopic process of the end cover 330 to adversely affect the extension and retraction of the end cover 330.

In the solution of the present embodiment, the outer circumference outline of the positioning block 313 is set to be rectangular, and the cross section outline of the spring 340 is set to have the rectangular shape matched with the outline of the positioning block 313, such that the elastic force of the spring 340 can be more uniformly applied to the end cover 330, thereby improving telescopic stability of the end cover 330.

Furthermore, in the solution of the present embodiment, the bottom end of the vertical beam body 310 may further be provided with a material injection hole for injecting a foaming material into the vertical beam body 310, so as to improve the heat insulation performance of the vertical beam assembly 300. The material injection hole is generally located in a middle of the positioning block 313 to avoid affecting a positioning effect of the positioning block 313 on the spring 340.

In some embodiments, the bottom end of the vertical beam may further be provided with a positioning groove, and the spring 340 is embedded in the positioning groove to position the spring 340.

In other embodiments, the end cover 330 may also be provided with a positioning block 313 or a positioning groove to position the spring 340.

Figure 13:
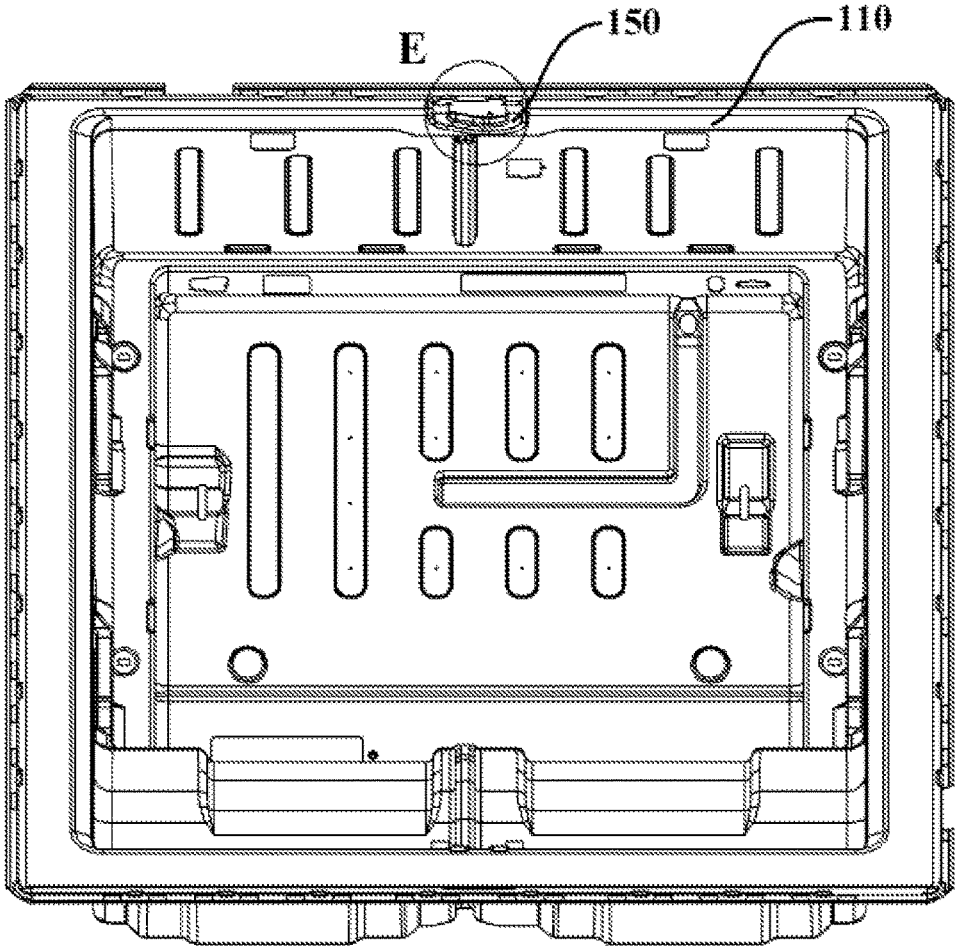
FIG. 13 is a schematic structural diagram of the inner liner of the refrigerator according to the embodiment of the present invention from another perspective.
Figure 14:
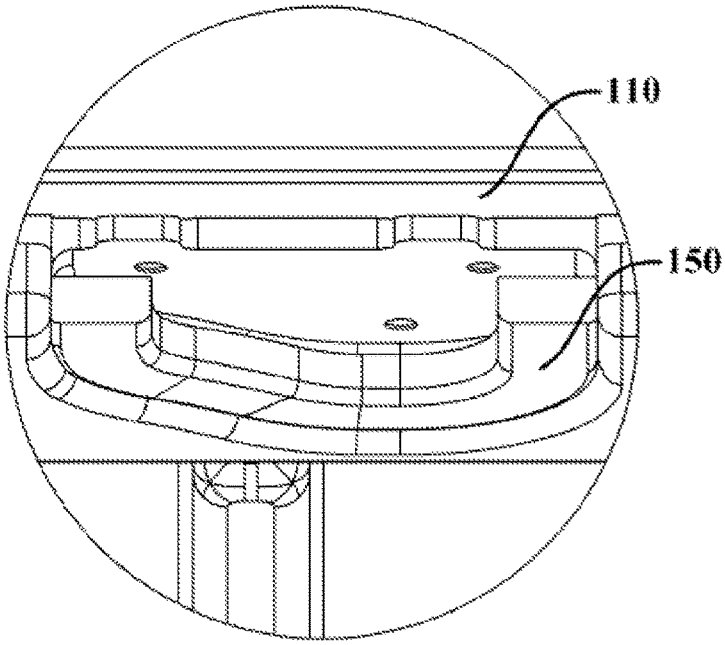
FIG. 14 is a partial enlarged view of region E of FIG. 13.

FIG. 13 is a schematic structural diagram of the inner liner 110 of the refrigerator 10 according to the embodiment of the present invention from another perspective. FIG. 14 is a partial enlarged view of region E of FIG. 13.

Referring to FIGS. 11 to 14, a first sealing part 140 and a second sealing part 150 are provided at positions of the bottom wall and a top wall of the inner liner 110 opposite to the vertical beam assembly 300 respectively, and when the first door 210 is closed, the vertical beam assembly 300 abuts against the first sealing part 140 and the second sealing part 150.

In the solution of the present embodiment, the first sealing part 140 and the second sealing part 150 are provided on the inner side of the bottom wall and an inner side of the top wall of the inner liner 110 respectively, and after the first door 210 is closed, the vertical beam assembly 300 abuts against the first sealing part 140 and the second sealing part 150, thus improving the sealing performance between the vertical beam assembly 300 and the cabinet 100.

The first sealing part 140 and the second sealing part 150 are configured as sealing strips, and an extending direction thereof is set according to a rotation track of the vertical beam assembly 300 on the inner liner 110.

In the solution of the present embodiment, the first sealing part 140 located on the bottom wall of the inner liner 110 and the second sealing part 150 located on the top wall of the inner liner 110 are configured as the sealing strips, and a specific structure of the sealing strips (i.e., the extending direction of the sealing strips) is set along the overturning track of the vertical beam assembly 300, such that the vertical beam assembly 300 is prevented from interfering with the first sealing part 140 and the second sealing part 150 in the overturning process, and then, normal overturning of the vertical beam assembly 300 is guaranteed while the sealing performance between the vertical beam assembly 300 and the cabinet 100 is improved.

In other embodiments, sealing parts (for example, silicone strips) may be further provided at the top end and the bottom end of the vertical beam assembly 300, and the sealing parts at the top end and the bottom end of the vertical beam assembly 300 abut against the first sealing part 140 and the second sealing part 150 respectively, thus further improving the sealing performance between the vertical beam assembly 300 and the cabinet 100.

In the solution of the present embodiment, the telescopic member 320 is provided at the bottom end of the vertical beam assembly 300, and the first sealing part 140 and the second sealing part 150 are provided on the inner sides of the bottom wall and the top wall of the inner liner 110, thus improving the sealing performance between the vertical beam assembly 300 and the cabinet 100, and then improving the refrigerating effect of the refrigerator 10 and use experiences of the user.

So far, it should be appreciated by those skilled in the art that while various exemplary embodiments of the invention have been shown and described in detail herein, many other variations or modifications which are consistent with the principles of this invention may be determined or derived directly from the disclosure of the present invention without departing from the spirit and scope of the invention. Accordingly, the scope of the invention should be understood and interpreted to cover all such other variations or modifications.

What is claimed is:

1. A refrigerator, comprising:

a cabinet having an inner liner, the inner liner defining a storage compartment having a front opening;

a side-by-side door assembly comprising a first door and a second door pivotably provided on both sides of the front opening of the storage compartment respectively, so as to open or close the storage compartment; and a vertical beam assembly overall rotatably mounted on a side of the first door apart from a pivoting center of the first door, and abutting against the second door when the first door and the second door are closed, so as to close a gap between the first door, the second door and the cabinet; and the vertical beam assembly comprising:

a vertical beam body; and a telescopic member telescopically provided at a bottom end of the vertical beam body and abutting against a bottom wall of the inner liner of the storage compartment;

wherein the telescopic member comprises:

an end cover clamped at the bottom end of the vertical beam body; and a spring provided above the end cover, and having one end abutting against the bottom end of the vertical beam body and the other end abutting against the end cover;

wherein a protruding rib is provided at a position of a front end of the bottom wall of the inner liner opposite to the end cover, so as to jack the end cover to correspondingly retract the end cover; and the protruding rib comprises:

a first transverse section located in a middle of the bottom wall of the inner liner and spaced apart from a front edge of the bottom wall of the inner liner by a set length;

a first inclined section and a second inclined section extending obliquely from both ends of the first transverse section to the front edge of the bottom wall of the inner liner respectively; and a second transverse section and a third transverse section oppositely extending from tail ends of the first inclined section and the second inclined section in a transverse direction respectively.

2. The refrigerator according to claim 1, wherein at least one buckle is provided at a lower portion of a side wall of the vertical beam body, at least one clamping portion is correspondingly provided on the end cover, and each clamping portion is fitted with each buckle to limit a maximum extension length of the end cover from the vertical beam body.

3. The refrigerator according to claim 1, wherein a lower portion of a side wall of the vertical beam body is further provided with a guide protrusion, the end cover is correspondingly provided with a guide groove, and the guide protrusion is fitted with the guide groove to guide the end cover to extend and retract.

4. The refrigerator according to claim 1, wherein an abutting surface is provided at a bottom end of the end cover, and an outer circumference outline of the end cover is gradually enlarged upwards from the abutting surface in a longitudinal direction.

5. The refrigerator according to claim 1, wherein the bottom end of the vertical beam body is further provided with a positioning block, and the spring is fitted over the positioning block to position the spring; and an outer circumference outline of the positioning block is generally rectangular, and a cross section outline of the spring has a rectangular shape matched with the outer circumference outline of the positioning block.

6. The refrigerator according to claim 1, wherein a first sealing part and a second sealing part are provided at positions of the bottom wall and a top wall of the inner liner opposite to the vertical beam assembly respectively, and when the first door is closed, the vertical beam assembly abuts against the first sealing part and the second sealing part.

7. The refrigerator according to claim 6, wherein the first sealing part and the second sealing part are configured as sealing strips, and an extending direction thereof is set according to a rotation track of the vertical beam assembly on the inner liner.

* * * * *